US007659794B2

(12) United States Patent
Tsai et al.

(10) Patent No.: US 7,659,794 B2
(45) Date of Patent: Feb. 9, 2010

(54) SINGLE-POLE-DOUBLE-THROW SWITCH INTEGRATED WITH BAND PASS FILTERING FUNCTION

(75) Inventors: Zuo-Min Tsai, Taipei (TW); Shih-Fong Chao, Taipei (TW); Huei Wang, Taipei (TW)

(73) Assignee: National Taiwan University, Taipei (TW)

( * ) Notice: Subject to any disclaimer, the term of this patent is extended or adjusted under 35 U.S.C. 154(b) by 91 days.

(21) Appl. No.: 12/134,097

(22) Filed: Jun. 5, 2008

(65) Prior Publication Data

US 2009/0115550 A1 May 7, 2009

(30) Foreign Application Priority Data

Nov. 2, 2007 (TW) ..... 96141316 A

(51) Int. Cl.
*H01P 1/15* (2006.01)
*H01P 5/12* (2006.01)

(52) U.S. Cl. ..... 333/104; 333/262

(58) Field of Classification Search ..... 333/101, 333/103, 104, 105, 262, 81 R, 81 A, 33, 32, 333/134

See application file for complete search history.

(56) References Cited

U.S. PATENT DOCUMENTS

| | | | | |
|---|---|---|---|---|
| 4,267,538 | A * | 5/1981 | Assal et al. | 333/262 |
| 5,193,218 | A * | 3/1993 | Shimo | 455/80 |
| 6,359,529 | B1 * | 3/2002 | Tsunoda et al. | 333/101 |
| 6,414,566 | B1 * | 7/2002 | Atokawa | 333/134 |
| 7,012,478 | B2 * | 3/2006 | Filleboeck et al. | 333/104 |
| 7,411,471 | B2 * | 8/2008 | Tsukahara | 333/104 |

* cited by examiner

*Primary Examiner*—Dean O Takaoka
(74) *Attorney, Agent, or Firm*—Schmeiser, Olsen & Watts LLP

(57) ABSTRACT

A single-pole-double-throw switch is provided, which is configured to be integrated with a bandpass filtering function and includes four quarter-wavelength transmission lines connected in series, five resonators connected in parallel to each other, and four transistors connected in parallel to four of the five resonators. When two of the four transistors are turned on and the others are turned off, the single-pole-double-throw switch is equivalent to a third-order quarter-wavelength short-circuited stub bandpass filter.

5 Claims, 5 Drawing Sheets

SINGLE-POLE-DOUBLE-THROW SWITCH INTEGRATED WITH BAND PASS FILTERING FUNCTION

FIELD OF THE INVENTION

The present invention relates to switches, and more particularly, to a single-pole-double-throw switch integrated with a bandpass filtering function.

BACKGROUND OF THE INVENTION

The quality of a time-division-duplex wireless communication system is greatly influenced by a radio frequency (RF) switch. In order to compensate for the undesirable characteristics of the switch (e.g. the on-state resistance and off-state capacitance), prior art adopts a parallel-resonator configuration to enable resonant of inductance and parasitic capacitance, as disclosed in, for example, "A high performance V-band monolithic FET transmit-receive switch" in 1988 *IEEE Microwave and Millimeter-wave Monolithic Circuits Symp. Dig.*, New York, N.Y./USA, Jun. 1988, pp. 99-101; "W-band SPST transistor switches", *IEEE Microwave and Guided Wave Lett.*, vol. 6, pp. 315-316, Sep. 1996; "A sub-nanosecond resonant-type monolithic T/R switch for millimeter-wave systems applications", IEEE *Trans. On Microwave Theory and Tech.*, vol. 46, no. 7, pp. 1016-1019, Jul. 1998; and U.S. Pat. No. 7,239,858, entitled "Integrated Switching Device For Routing Radio Frequency Signals", or adopts an impedance transformation network to switch the resistance and capacitance of the switch, as disclosed in, for example, "Millimeter-wave MMIC single-pole-double-throw passive HEMT switches using impedance transformation networks", *IEEE Trans. Microwave Theory Tech.*, vol. 51, pp. 1076-1085, Apr. 2003; and U.S. Pat. No. 6,801,108, entitled "A Millimeter-wave Switch Using Impedance Transformation Networks". However, the above conventional techniques can only compensate for the resistance and capacitance of particular frequencies, but they fail to consider the frequency response of the overall system.

In "Millimeter-wave MMIC passive HEMT switches using traveling-wave concept" (referring to *IEEE Trans. Microwave Theory and Tech.*, vol. 52, no. 8, pp. 1798-1808, Aug. 2004), a traveling-wave switch configuration is proposed, which integrates additional inductance into an artificial transmission line. This configuration allows integration of the undesirable characteristics into the transmission line, and thus the switch may have a wideband frequency response and good switching characteristics.

Since the undesirable characteristics of the switch are equivalent to lumped elements, U.S. Pat. No. 7,106,146 (entitled "RF Switch") performs effective impedance matching with these equivalent lumped elements. Accordingly, other techniques have been proposed to replace the elements in a filter with switching elements, so that the filter may assume the characteristic of a single-pole-single-throw switch, as can be found in, for example, "Theoretical and Experimental Investigation of Novel Varactor-Tuned Switchable Microstrip Ring Resonator Circuits", *IEEE Trans. Microwave Theory and Tech.*, vol. 36, no. 12, Dec. 1988, pp. 1733-1739; "A band-pass filter-integrated switch using field-effect transistors and its power analysis", in 2006 *IEEE MTT-S Int. Microwave Symp. Dig.*, San Francisco, Calif./USA, 2006; and "New millimeter-wave MMIC switch design using the image-filter synthesis method", *IEEE Microwave and Wireless Component Lett.*, vol. 14, pp. 103-105, Mar. 2004.

For example, in the above prior art, "A band-pass filter-integrated switch using field-effect transistors and its power analysis", a quarter-wavelength impedance transformer 12 is used to integrate two single-pole-single-throw traveling-wave switches 14 and 16 into a single-pole-double-throw switch 10, as shown in FIG. 1. Similar integration can be applied to single-pole-five-throw switches, for example, in U.S. Pat. No. 7,106,146, entitled "High Frequency Switch". However, as limited by the quarter-wavelength impedance transformer 12, the frequency response of the single-pole-double-throw switch 10 cannot be synthesized. This is because the single-pole-double-throw switch 10 must include two single-pole-single-throw switches 14 and 16, and the impedances and frequency responses of the two single-pole-single-throw switches 14 and 16 may affect each other. The impedance transformer 12 may alleviate this influence. Nonetheless, the frequency response of the impedance transformer 12 itself may still influence the frequency responses of the single-pole-single-throw switches 14 and 16. Therefore, the filter function cannot be effectively integrated into the single-pole-double-throw switch 10.

SUMMARY OF THE INVENTION

In light of foregoing drawbacks, an objective of the present invention is to provide a single-pole-double-throw switch integrated with a bandpass filtering function, which integrates the bandpass filtering function into the switch by taking advantage of the undesirable characteristics of the switch.

In accordance with the above and other objectives, the present invention provides a single-pole-double-throw switch integrated with a bandpass filtering function, comprising: a first transmission line; a second transmission line with a first end being coupled to a second end of the first transmission line; a third transmission line with a first end being coupled to a second end of the second transmission line; a fourth transmission line with a first end being coupled to a second end of the third transmission line; a first resonator with a first end being coupled to a first end of the first transmission line and an opposing second end being grounded; a first transistor having a drain being coupled to the first end of the first transmission line, a source being grounded, and a gate for receiving a first selection signal; a second resonator with a first end being coupled to the second end of the first transmission line and an opposing second end being grounded; a second transistor having a drain being coupled to the second end of the first transmission line, a source being grounded, and a gate for receiving the first selection signal; a third resonator with a first end being coupled to the first end of the fourth transmission line and an opposing second end being grounded; a third transistor having a drain being coupled to the first end of the fourth transmission line, a source being grounded, and a gate for receiving a second selection signal; a fourth resonator with a first end being coupled to a second end of the fourth transmission line and an opposing second end being grounded; a fourth transistor having a drain being coupled to the second end of the fourth transmission line, a source being grounded, and a gate for receiving the second selection signal; and a fifth resonator with a first end being coupled to the second end of the second transmission line and an opposing second end being grounded, wherein the first transmission line, the second transmission line, the third transmission line and the fourth transmission line are of length equal to a quarter of a wavelength of the RF signals.

BRIEF DESCRIPTION OF THE DRAWINGS

The present invention can be more fully understood by reading the following detailed description of the preferred embodiments, with reference made to the accompanying drawings, wherein.

DETAILED DESCRIPTION OF THE EMBODIMENTS

The present invention is described by the following specific embodiments. Those with ordinary skills in the arts can readily understand the other advantages and functions of the present invention after reading the disclosure of this specification. The present invention can also be implemented with different embodiments. Various details described in this specification can be modified based on different viewpoints and applications without departing from the scope of the present invention.

Figure 2:
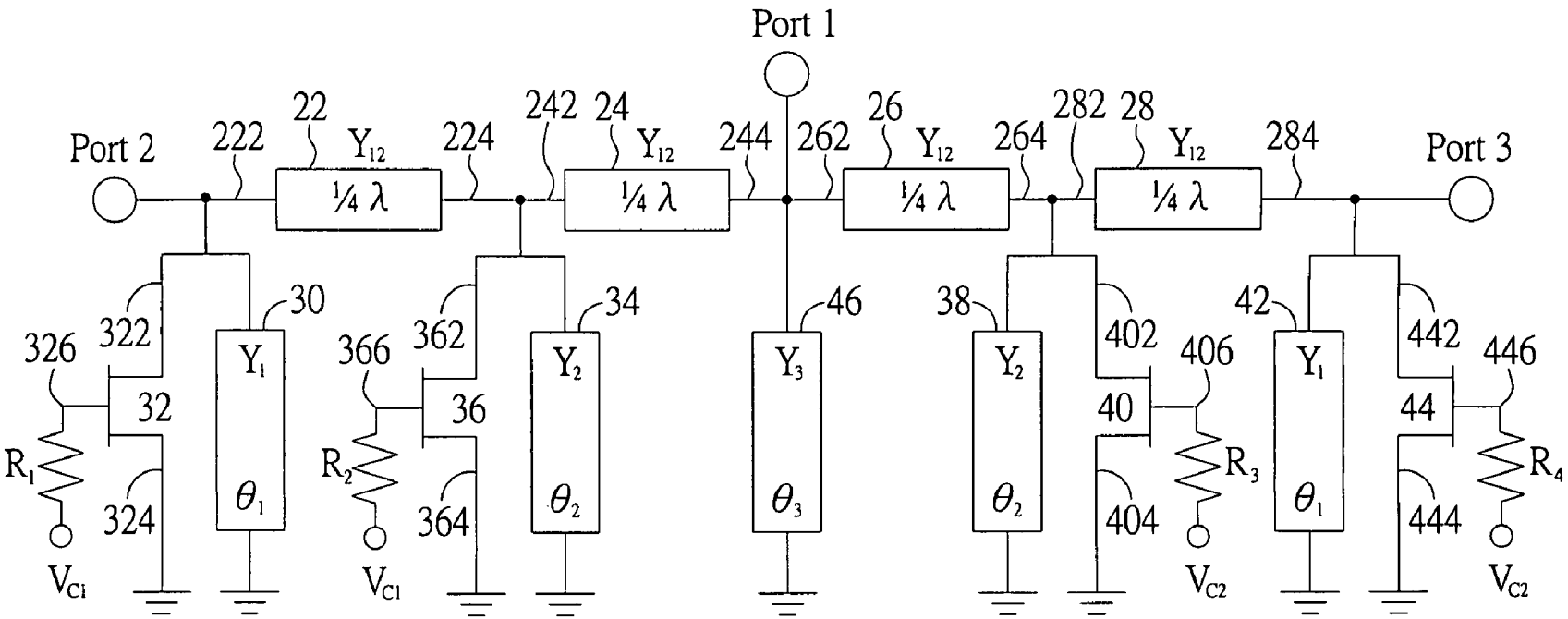
FIG. 2 is a circuit diagram of a single-pole-double-throw switch according to an embodiment of the present invention.
Figure 3:
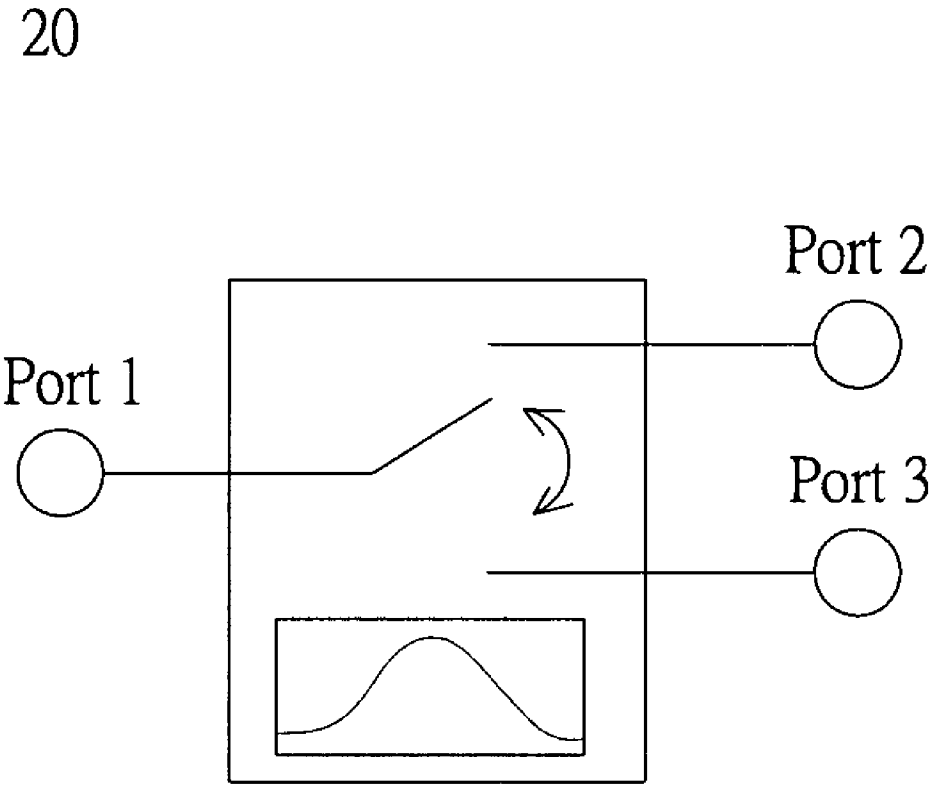
FIG. 3 is an equivalent functional block diagram of the single-pole-double-throw switch of FIG. 2.

Referring to FIGS. 2 and 3, FIG. 2 is a circuit diagram illustrating a single-pole-double-throw switch 20 integrated with a bandpass filtering function according to an embodiment of the present invention, and FIG. 3 is a functional block diagram of the single-pole-double-throw switch 20. The single-pole-double-throw switch 20 is used to pass (receive/transmit (R/T)) radio frequency (RF) signals. For instance, when the single-pole-double-throw switch 20 is switched by connecting a first port Port1 to a second port Port2, the first port Port1 receives RF signals transmitted from the second port Port2. Conversely, when the single-pole-double-throw switch 20 is switched by connecting the first port Port1 to a third port Port3, the first port Port1 transmits RF signals to the third port Port3.

As shown in FIG. 2, the single-pole-double-throw switch 20 includes a first transmission line 22; a second transmission line 24 with a first end 242 being coupled to a second end 224 of the first transmission line 22; a third transmission line 26 with a first end 262 being coupled to a second end 244 of the second transmission line 24; a fourth transmission line 28 with a first end 282 being coupled to a second end 264 of the third transmission line 26; a first resonator 30 with an end being coupled to a first end 222 of the first transmission line 22 and an opposing end being grounded; a first transistor 32 having a drain 322 being coupled to the first end 222 of the first transmission line 22, a source 324 being grounded, and a gate 326 for receiving a first selection signal $V_{c1}$ via a first resistor $R_1$; a second resonator 34 with an end being coupled to the second end 224 of the first transmission line 22 and an opposing end being grounded; a second transistor 36 having a drain 362 being coupled to the second end 224 of the first transmission line 22, a source 364 being grounded, and a gate 366 for receiving the first selection signal $V_{c1}$ via a second resistor $R_2$; a third resonator 38 with an end being coupled to the first end 282 of the fourth transmission line 28 and an opposing end being grounded; a third transistor 40 having a drain 402 being coupled to the first end 282 of the fourth transmission line 28, a source 404 being grounded, and a gate 406 for receiving a second selection signal $V_{c2}$ via a third resistor $R_3$; a fourth resonator 42 with an end being coupled to a second end 284 of the fourth transmission line 28 and an opposing end being grounded; a fourth transistor 44 having a drain 442 being coupled to the second end 284 of the fourth transmission line 28, a source 444 being grounded, and a gate 446 for receiving the second selection signal $V_{c2}$ via a fourth resistor $R_4$; and a fifth resonator 46 with an end being coupled to the second end 244 of the second transmission line 24 and an opposing end being grounded, wherein the first transmission line 22, the second transmission line 24, the third transmission line 26 and the fourth transmission line 28 are of length equal to a quarter of a wavelength λ of the RF signals (i.e. ¼λ).

When the first selection signal $V_{c1}$ is lower than the threshold voltages of the first transistor 32 and the second transistor 36, and when the second selection signal $V_{c2}$ is higher than the threshold voltages of the third transistor 40 and the fourth transistor 44, the first transistor 32 and the second transistor 36 are turned off, and the third transistor 40 and the fourth transistor 44 are turned on. Thus, the first transistor 32 and the second transistor 36 are equivalent to a first capacitance $C_{off1}$ and a second capacitance $C_{off2}$, respectively, while the third transistor 40 and the fourth transistor 44 are equivalent to a second on-state resistance $G_{on2}$ and a first on-state resistance $G_{on1}$, respectively, as shown in FIG. 4.

The RF signal from the first port Port1 to the second on-state resistance $G_{on2}$ via the third transmission line 26 would be reflected by ground, and returned to the first port Port1 via the third transmission line 26, which cancels another RF signal subsequently coming from the first port Port1 to the second on-state resistance $G_{on2}$ via the third transmission line 26. As such, RF signals would equivalently be transmitted between the first port Port1 and the second port Port2, rather than between the first port Port1 and the third port Port3. Thus, the single-pole-double-throw switch 20 is equivalent to a third-order quarter-wavelength short-circuited stub bandpass filter 20' shown in FIG. 5.

Figure 5:
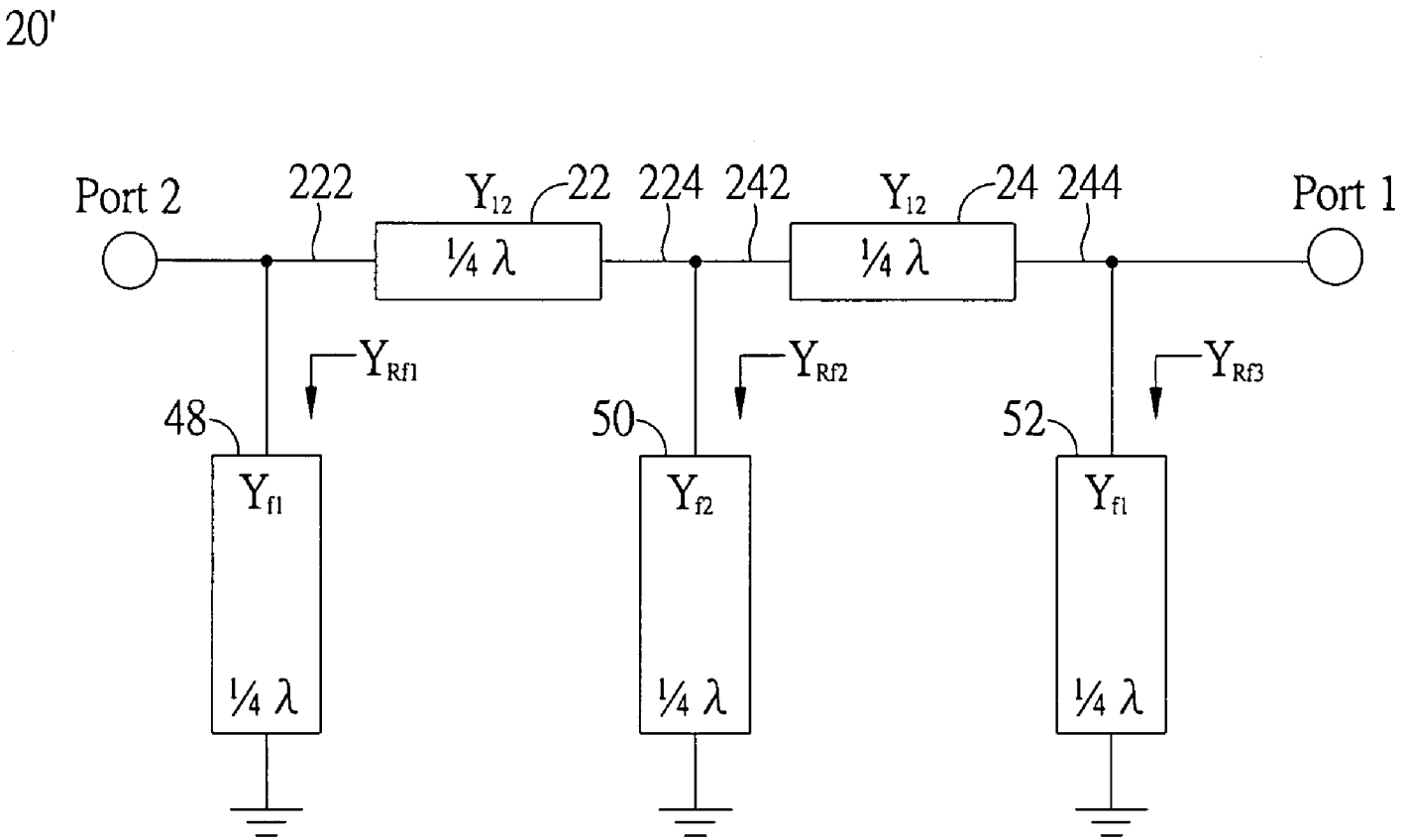
FIG. 5 is a circuit diagram of an equivalent bandpass filter of the single-pole-double-throw switch of FIG. 4.

In FIG. 5, the third-order quarter-wavelength short-circuited stub bandpass filter 20' includes the first transmission line 22; the second transmission line 24 with the first end 242 being coupled to the second end 224 of the first transmission line 22; a sixth resonator 48 with an end being coupled to the first end 222 of the first transmission line 22 and an opposing end being grounded; a seventh resonator 50 with an end being coupled to the first end 242 of the second transmission line 24 and an opposing end being grounded; and an eighth resonator 52 with an end being coupled to the second end 244 of the second transmission line 24 and an opposing end being grounded.

Figure 4:
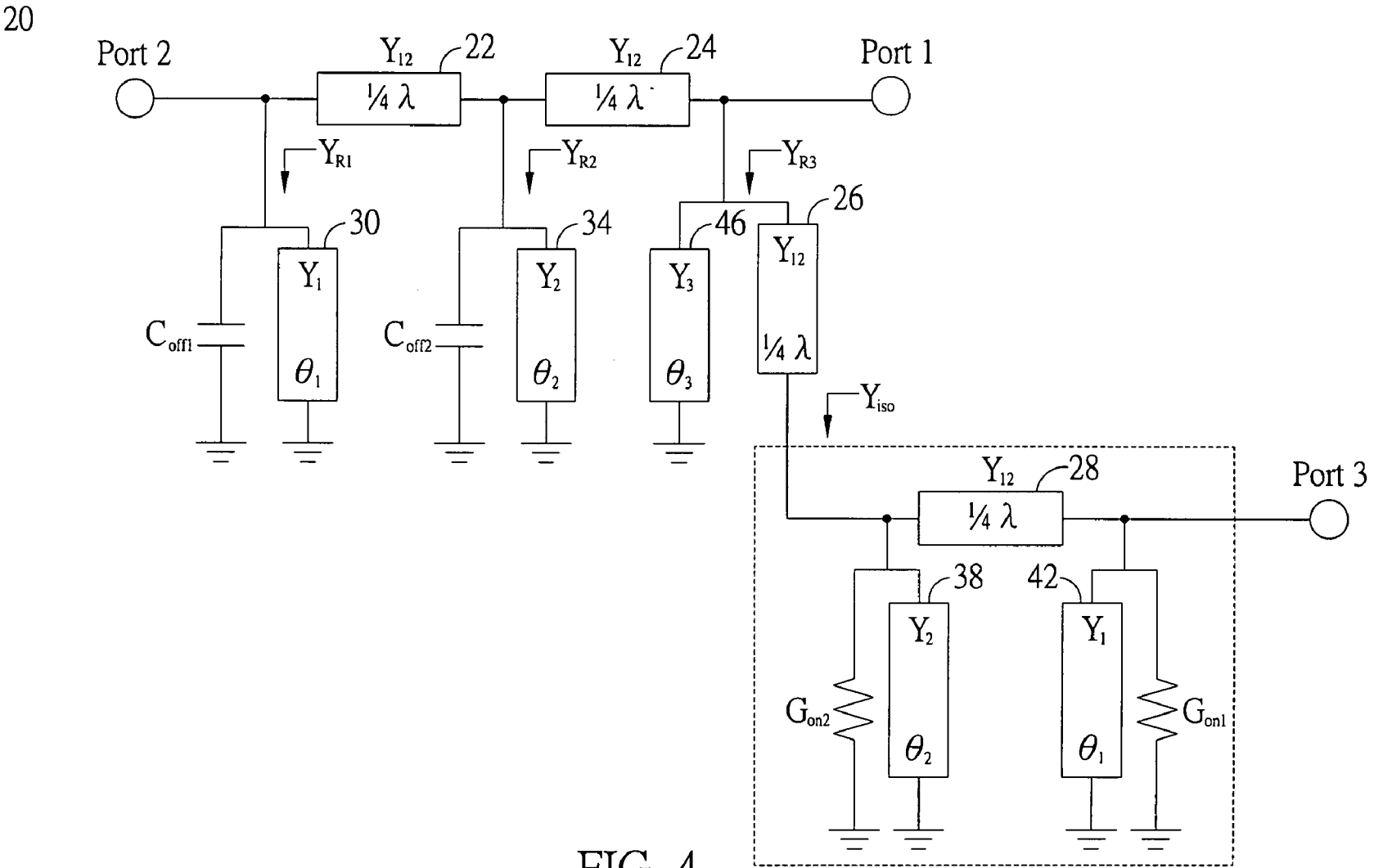
FIG. 4 is an equivalent circuit diagram of the single-pole-double-throw switch of FIG. 2.

Since the third-order quarter-wavelength short-circuited stub bandpass filter 20' shown in FIG. 5 is equivalent to the single-pole-double-throw switch 20 shown in FIG. 4, the susceptances $Y_{Rf1}$, $Y_{Rf2}$ and $Y_{Rf3}$ of the respective sixth, seventh and eighth resonators 48, 50 and 52 and the differential values of the susceptances $Y_{Rf1}$, $Y_{Rf2}$ and $Y_{Rf3}$ at the central frequency $\omega_0$ are equal to the susceptances $Y_{R1}$, $Y_{R2}$ and $Y_{R3}$ of the respective first, second and fifth resonators 30, 34 and 46 and the differential values of the susceptances $Y_{Rf1}$, $Y_{Rf2}$ and $Y_{Rf3}$ at the central frequency $\omega_0$, respectively.

Accordingly, the design parameters of the third-order quarter-wavelength short-circuited stub bandpass filter 20' and the single-pole-double-throw switch 20 should satisfy the following equations:

$$Im(Y_{R1})=Im(Y_{Rf1})=\omega_0 C_{off1}--Y_1 \cot\theta_1=0 \quad (1)$$

$$Im(Y_{R2})=Im(Y_{Rf2})=\omega_0 C_{off2}--Y_2 \cot\theta_2=0 \quad (2)$$

$$Im(Y_{R3})=Im(Y_{Rf3})=Im(Y_{12}^2/Y_{iso}-jY_3 \cot\theta_3)=0 \quad (3)$$

wherein $Y_{12}$ is the admittance of the third transmission line 26; $Y_1$, $Y_2$ and $Y_3$ are the admittances of the first, second and fifth resonators 30, 34 and 46, respectively; $\theta_1$, $\theta_2$, and $\theta_3$ are the phase shifts of the first, second and fifth resonators 30, 34 and 46, respectively; and $Y_{iso}$ in Equation (3) is the admittance from the on-state third transistor 40 to the isolated second port Port2. Since the third and fourth transistors 40 and 44 are turned on, the second and first on-state resistances $G_{on2}$ and $G_{on1}$ have very large conductance. Thus, $$Y_{iso} = G_{on2} - jY_2\cot\theta_2 + \frac{Y_{12}^2}{Y_0 + G_{on1} - jY_1\cot\theta_1} \cong G_{on2}. \quad (4)$$

Since the differential values of these susceptances should be equal to each other, therefore, $$Y_{Rf1}\frac{\pi}{4\omega_0} = C_{off1} + \frac{Y_1\theta_1}{\omega_0}\csc^2\theta_1 \quad (5)$$

$$Y_{Rf2}\frac{\pi}{4\omega_0} = C_{off2} + \frac{Y_2\theta_2}{\omega_0}\csc^2\theta_2 \quad (6)$$

$$Y_{Rf3}\frac{\pi}{4\omega_0} = \frac{Y_3\theta_3}{\omega_0}\csc^2\theta_3 - \frac{\pi Y_{12}(G_{on2}^2 - Y_{12}^2)}{2\omega_0 G_{on2}^2}. \quad (7)$$

By adopting a filter synthesis technique, the third-order quarter-wavelength short-circuited stub bandpass filter 20' can be designed to have design parameters $Y_{12}$, $Y_{Rf1}$, $Y_{Rf2}$ and $Y_{Rf3}$, etc. When the device size is determined, $C_{off1}$, $C_{off2}$, $G_{off3}$, and $G_{on2}$ can be calculated. Next, the design parameters $Y_{12}$, $Y_1$, $Y_2$, $Y_3$, $\theta_1$, $\theta_2$ and $\theta_3$ can then be calculated from Equations (1) to (7).

When calculating insertion loss $S_{21}$ from the first port Port1 via the second transmission line 24 and the first transmission line 22 to the second port Port2, only the second on-state resistance $G_{on2}$ is considered. As can be seen from Equations (1) to (3), $Y_{R1}$, $Y_{R2}$, and $Y_{R3}$ are all zero at $\omega_0$. Thus, the insertion loss $S_{21}$ can be expressed as:

$$S_{21} = -\frac{Y_0}{Y_0 + \frac{Y_{12}^2}{2G_{on2}} - j\frac{Y_3\cot\theta_3}{2}}. \quad (8)$$

Similarly, insertion loss $S_{31}$ from the first port Port1 to the third port Port3 can be calculated. Since $$Y_{iso} = -\frac{Y_{12}^2}{Y_0}, \quad (9)$$

$$S_{31} = -\frac{2Y_0}{(G_{on1} + Y_0 - jY_1\cot\theta_1 + (Y_{21}^2 + (G_{on1} + Y_0 - jY_1\cot\theta_1)(G_{on2} - jY_2\cot\theta_2))(2Y_0 - jY_3\cot\theta_3))/Y_{21}^2}.$$

As can be seen from Equations (8) and (9), increasing the second on-state resistance $G_{on2}$ and the first on-state resistance $G_{on1}$ improves the insertion losses $S_{21}$ and $S_{31}$ as well as the degree of isolation.

It should be noted that in order for Equations (1) to (7) to have a solution, the first capacitance $C_{off1}$ and the second capacitance $C_{off2}$ should fall within a reasonable range. Moreover, since the first capacitance $C_{off1}$ and the second capacitance $C_{off2}$ are the off-state channel resistances of the first transistor 32 and the second transistor 36, respectively, the second on-state resistance $G_{on2}$ and the first on-state resistance $G_{on1}$ are the on-state channel resistances of the third transistor 40 and the fourth transistor 44, respectively, and the first capacitance $C_{Off1}$, the second capacitance $C_{Off2}$, the second on-state resistance $G_{on2}$ and the first on-state resistance $G_{on1}$ are proportional to the widths of the gates 326, 366, 406 and 446 of the first, second, third and fourth transistors 32, 36, 40 and 44, respectively, the first, second, third and fourth transistors 32, 36, 40 and 44 have to be selected properly in order for Equations (1) to (7) to be solvable.

In the single-pole-double-throw switch 20 shown in FIG. 2, the first resonator 30 is identical to the fourth resonator 42, and the second resonator 34 is identical to the third resonator 38. In other words, the equivalent bandpass filters in the cases where the single-pole-double-throw switch 20 is receiving (Port1 connected to Port2) or transmitting (Port1 connected to Port3) RF signals have exactly identical bandpass filtering characteristics. However, it should be appreciated that, in the single-pole-double-throw switch of the present invention, different first resonator 30 and fourth resonator 42 and/or different second resonator 34 and third resonator 38 can be selected, depending on the bandpass filtering characteristics required for receiving/transmitting RF signals.

Figure 1:
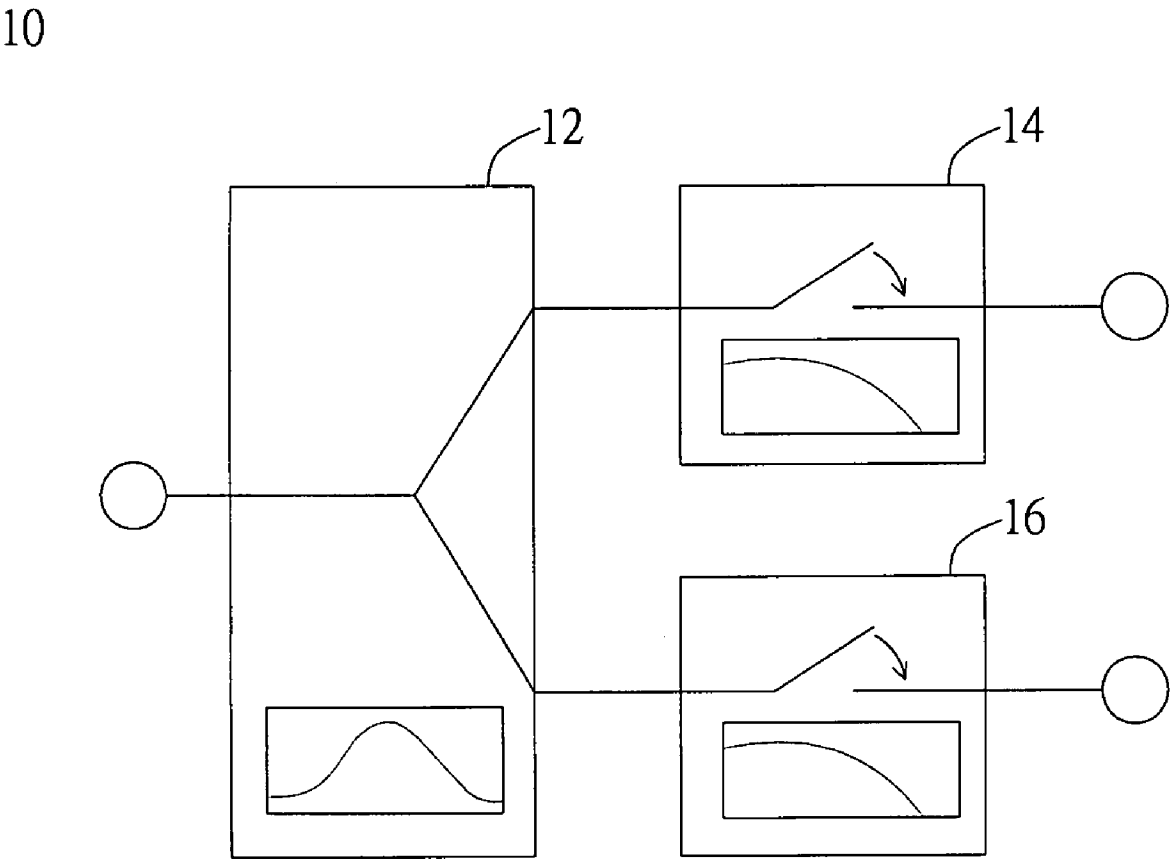
FIG. 1 (PRIOR ART)
FIG. 1 is a functional block diagram of a conventional single-pole-double-throw switch.

Compared to the prior art, the single-pole-double-throw switch of the present invention has been integrated with a bandpass filtering function, so that the addition of a bandpass filter is no longer required. In addition, since the undesirable characteristics of the switch have been integrated as part of the bandpass filter, the single-pole-double-throw switch of the present invention does not require additional circuitry (e.g. the impedance transformer 12 of FIG. 1) to compensate for the undesirable characteristics of the switch. Furthermore, since the undesirable characteristics of the switch have been integrated as part of the bandpass filter, the synthesizing steps of the filter can be used to design the switch of the present invention, thereby greatly reducing the steps and complexity of the switch.

The above embodiments are only used to illustrate the principles of the present invention, and they should not be construed as to limit the present invention in any way. The above embodiments can be modified by those with ordinary skills in the arts without departing from the scope of the present invention as defined in the following appended claims.

What is claimed is:

1. A single-pole-double-throw switch integrated with a bandpass filtering function for passing radio frequency (RF) signals, the single-pole-double-throw switch comprising:

a first transmission line;

a second transmission line with a first end being coupled to a second end of the first transmission line;

a third transmission line with a first end being coupled to a second end of the second transmission line;

a fourth transmission line with a first end being coupled to a second end of the third transmission line;

a first resonator with a first end being coupled to a first end of the first transmission line and an opposing second end being grounded;

a first transistor having a drain being coupled to the first end of the first transmission line, a source being grounded, and a gate for receiving a first selection signal;

a second resonator with a first end being coupled to the second end of the first transmission line and an opposing second end being grounded;

a second transistor having a drain being coupled to the second end of the first transmission line, a source being grounded, and a gate for receiving the first selection signal;

a third resonator with a first end being coupled to the first end of the fourth transmission line and an opposing second end being grounded;

a third transistor having a drain being coupled to the first end of the fourth transmission line, a source being grounded, and a gate for receiving a second selection signal;

a fourth resonator with a first end being coupled to a second end of the fourth transmission line and an opposing second end being grounded;

a fourth transistor having a drain being coupled to the second end of the fourth transmission line, a source being grounded, and a gate for receiving the second selection signal; and a fifth resonator with a first end being coupled to the second end of the second transmission line and an opposing second end being grounded, wherein the first transmission line, the second transmission line, the third transmission line and the fourth transmission line are of length equal to a quarter of a wavelength of the RF signals.

2. The single-pole-double-throw switch of claim 1, wherein the first resonator is identical to the fourth resonator, and the second resonator is identical to the third resonator.

3. The single-pole-double-throw switch of claim 1, which is equivalent to a third-order quarter-wavelength short-circuited stub bandpass filter when the first selection signal turns off the first and second transistors and the second selection signal turns on the third and fourth transistors, the single-pole-double-throw switch.

4. The single-pole-double-throw switch of claim 3, wherein the third-order quarter-wavelength short-circuited stub bandpass filter comprises:

the first transmission line;

the second transmission line with the first end being coupled to the second end of the first transmission line;

a sixth resonator with a first end being coupled to the first end of the first transmission line and an opposing second end being grounded;

a seventh resonator with a first end being coupled to the first end of the second transmission line and an opposing second end being grounded; and an eighth resonator with a first end being coupled to the second end of the second transmission line and an opposing second end being grounded.

5. The single-pole-double-throw switch of claim 4, wherein the third-order quarter-wavelength short-circuited stub bandpass filter and the single-pole-double-throw switch satisfy the following equations:

$$\mathrm{Im}(Y_{R1}) = \mathrm{Im}(Y_{Rf1}) = \omega_0 C_{off1} - Y_1 \cot\theta_1 = 0; \tag{1}$$

$$\mathrm{Im}(Y_{R2}) = \mathrm{Im}(Y_{Rf2}) = \omega_0 C_{off2} - Y_2 \cot\theta_2 = 0; \tag{2}$$

$$\mathrm{Im}(Y_{R3}) = \mathrm{Im}(Y_{Rf3}) = \mathrm{Im}(Y_{12}^2 / Y_{iso} - jY_3 \cot\theta_3) = 0; \tag{3}$$

$$Y_{iso} = G_{on2} - jY_2 \cot\theta_2 + \frac{Y_{12}^2}{Y_0 + G_{on1} - jY_1 \cot\theta_1} \cong G_{on2}; \tag{4}$$

$$Y_{Rf1} \frac{\pi}{4\omega_0} = C_{off1} + \frac{Y_1\theta_1}{\omega_0} \csc^2\theta_1; \tag{5}$$

$$Y_{Rf2} \frac{\pi}{4\omega_0} = C_{off2} + \frac{Y_2\theta_2}{\omega_0} \csc^2\theta_2; \text{ and} \tag{6}$$

$$Y_{Rf3} \frac{\pi}{4\omega_0} = \frac{Y_3\theta_3}{\omega_0} \csc^2\theta_3 - \frac{\pi Y_{12}(G_{on2}^2 - Y_{12}^2)}{2\omega_0 G_{on2}^2}, \tag{7}$$

wherein $Y_{12}$ is an admittance of the third transmission line; $Y_1$, $Y_2$ and $Y_3$ are admittances of the first, second and fifth resonators, respectively; $\theta_1$, $\theta_2$, and $\theta_3$ are phase shifts of the first, second and fifth resonators, respectively; $C_{off1}$ and $C_{off2}$ are equivalent first and second capacitances of the turned-off first and second transistors, respectively; $G_{on2}$ and $G_{on1}$ are equivalent second and first on-state resistances of the turned-on third and fourth transistors, respectively; $Y_{Rf1}$, $Y_{Rf2}$ and $Y_{Rf3}$ are susceptances of the sixth, seventh and eighth resonators of the third-order quarter-wavelength short-circuited stub bandpass filter, respectively; $Y_{iso}$ is an admittance from the turned-on third transistor to the isolated second end of the fourth transmission line; and $\omega_0$ is a central frequency of the third-order quarter-wavelength short-circuited stub bandpass filter.

* * * * *